US006433706B1

(12) United States Patent
Anderson, III et al.

(10) Patent No.: US 6,433,706 B1
(45) Date of Patent: Aug. 13, 2002

(54) LICENSE PLATE SURVEILLANCE SYSTEM

(76) Inventors: Philip M. Anderson, III, 37 Winding Way, Madison, NJ (US) 07940; Hector Irizarry, 600 Madison St., Hoboken, NJ (US) 07030

( * ) Notice: Subject to any disclaimer, the term of this patent is extended or adjusted under 35 U.S.C. 154(b) by 0 days.

(21) Appl. No.: 09/748,426

(22) Filed: Dec. 26, 2000

(51) Int. Cl.[7] ..... G08G 1/017
(52) U.S. Cl. ..... 340/937; 340/933
(58) Field of Search ..... 340/435, 903, 340/928, 932.2, 933, 937, 942, 936; 348/148, 149; 701/1, 32; 705/28, 30, 418

(56) References Cited

U.S. PATENT DOCUMENTS

| | | | | | |
|---|---|---|---|---|---|
| 4,817,166 | A | | 3/1989 | Gonzalez et al. | 382/105 |
| 4,866,438 | A | | 9/1989 | Knisch | 340/936 |
| 5,381,155 | A | | 1/1995 | Gerber | 342/104 |
| 5,414,626 | A | * | 5/1995 | Boorse et al. | 701/32 |
| 5,623,403 | A | * | 4/1997 | Highbloom | 705/28 |
| 6,052,068 | A | | 4/2000 | Price et al. | 340/933 |
| 6,081,206 | A | | 6/2000 | Kielland | 340/937 |

* cited by examiner

*Primary Examiner*—Van Trieu
(74) *Attorney, Agent, or Firm*—Ernest D. Buff & Associates; Ernest D. Buff

(57) ABSTRACT

A license plate number for any vehicle extant within a field of view of an electronic camera is interpreted as a character sequence group in an image. Each character sequence group found in the image is converted to machine readable format by an optical character recognition engine and compared with a database having a plurality of license plate numbers and associated records. Each matching license plate number and associated record is displayed within the surveillance vehicle.

14 Claims, 8 Drawing Sheets

LICENSE PLATE SURVEILLANCE SYSTEM

BACKGROUND OF THE INVENTION

1. Field of the Invention

The present invention relates to the identification of land vehicle license plates; and more particularly, to a license plate number recognition system mounted on a surveillance vehicle such as a police car or the like.

2. Description of the Prior Art

Identification of motor vehicles on the road is known in the art. U.S. Pat. No. 6,052,068 to Price et al. discloses a vehicle identification system for identifying one or more motor vehicles within a group of vehicles at distances in excess of 200 feet. The system requires special vehicle identification tags to be attached to the vehicles for receiving interrogation signals and sending a response signal to an interrogator. U.S. Pat. No. 4,866,438, to Knisch, discloses a traffic-monitoring device for photographically recording vehicles that exceed a predetermined speed. The vehicles are photographed frontally when they exceed the predetermined speed. The photograph is processed and inspected manually to ascertain the license plate number of the speeding vehicle.

A license plate number reader was announced in April 1994 and is available from Racal Radio Limited, Reading, England. It reads license plates from a recorded video image using recognition techniques and neural networks. The system includes a camera, lighting, plate recognition unit and keyboard and cost about 20 thousand dollars in 1994. U.S. Pat. 4,817,166, to Gonzalez, et al., discloses a device for reading a license plate. The Gonzales, et al. device uses a video camera to produce an image of a license plate on a vehicle, and a scanning means to locate a license plate number in the image. The identification of the license plate number is verified in a confidence check section by checking for the presence of a state logo. It incorporates decision means for comparing the block to second criteria to determine and indicate whether a block is an image of the license plate characters.

U.S. Pat. No. 5,381,155 to Gerber discloses a method and system of traffic control which includes the steps of measuring the speed of a vehicle, automatically reading the license plate of the vehicle, using a computer system to automatically match the license plate number with information about the owner of the vehicle, and displaying the name of the owner of the vehicle.

U.S. Pat. 6,081,206 to Kielland discloses a parking regulation enforcement system having a video camera mounted on a parking enforcement patrol vehicle and connected to a computer near the operator. The system is driven along a patrol route where parked vehicles are governed by a posted time limit. The system enforces the local parking regulation by reading license plate numbers and automatically determining whether or not each parked car has been parked longer than the posted time limit. The system makes no determination of whether the car is stolen, or if its owner is missing or wanted by the police.

Each of the above described license plate readers is completely automated. As a result, the information match must be very accurate. Information provided by the search mechanism is, of necessity, highly specific. That is to say, the image provided by the search mechanism must include substantially the entire license plate before the license plat number is interpreted. Some of the prior art systems perform additional checks, such as identifying the state logo, to improve accuracy. As a result, previous vehicle identification systems of the type described are complicated and expensive. The high degree of accuracy required of automated vehicle identification systems causes license plate numbers to be missed, oftentimes preventing proper identification of incorrect license plate numbers.

It is not unusual for a police officer in a patrol car to follow hundreds of vehicles each day in the normal course of duty. Some of these vehicles may be stolen; or the vehicle owners may be wanted by police. It is not practical for the officer to manually check all the license plates of these vehicles. Typically, the only vehicles that undergo a license plate check are those found to have violated a traffic law or which somehow arouse the suspicion of the officer.

The exists a need in the art for a vehicle identification system which (i) continually monitors the license plates of vehicles in the path of a police vehicle; (ii) automatically checks law enforcement databases to ascertain owner identification and vehicle information; and (iii) flags the record on a display if the legal status of the vehicle or its owner is the subject of an investigation. Such a system need not determine whether the character sequences it finds in an image are identical with those resident in the law enforcement database. It should be capable of withstanding occasional inaccuracies while increasing the incidence rate of potential license plate identifications, since the officer can visually verify whether the matched license plate number is correct. Also needed is a vehicle identification system that remains operable whether the surveillance vehicle, the target vehicle, or both are stationary or moving. Previous vehicle identifications systems do not fill this need.

SUMMARY OF THE INVENTION

The present invention provides a method and system for surveillance of license plate numbers from a vehicle mounted camera in situations where the surveillance vehicle and the target vehicle may both be moving. Specifically, the invention provides a license plate surveillance system having an electronic camera mounted on a surveillance vehicle for capturing an image of the license plate. A processor having an optical character recognition engine converts character sequence groups within the image to machine readable format. The processor is additionally provided with means for matching the character sequence groups with license plate numbers resident in a license plate number database. Each of the license plate numbers in the database is associated with a record that contains information about the vehicle and its owner. Matched records detected by the system are indicated on a display device disposed within the surveillance vehicle.

Alternatively, the database of license plate numbers is in a location remote from the surveillance vehicle. In this embodiment, the system further comprises a server associated with the database. Communication between the surveillance vehicle and the database is accomplished using a wireless transceiver within the surveillance vehicle for transmitting the character sequence groups to the server and receiving the associated records of matched license plate numbers. A wireless transceiver associated with the server receives the character sequence groups and sends the records of matched license plate numbers to the surveillance vehicle.

The invention also provides a method for identifying license plate numbers, using an electronic camera mounted on a surveillance vehicle. A video image is captured with the electronic camera; then any character sequence groups within the image are converted to machine readable format using a processor having an optical character recognition engine. The character sequence groups are compared with license plate numbers in the database in order to find at least one match. The record associated with a matched character sequence group is displayed on a display device in the surveillance vehicle. In this manner, a license plate number of any vehicle present within a field of view of the electronic camera is interpreted as a character sequence group. The character sequence groups found in the image are converted to machine-readable format by the optical character recognition engine and are compared with the database. Any matching license plate number and its associated record is displayed within the surveillance vehicle.

Alternatively, the database is housed in a location remote from the surveillance vehicle, and the method additionally comprises the steps of (i) sending the character sequence groups to a remote server that is associated with the database via a wireless connection, and (ii) sending the matching license plate number and its associated record via wireless connection to the surveillance vehicle.

The invention provides a method and system that searches continuously for license plate numbers without having to search for the license plate in the image. Unlike previous vehicle identification systems, no component is designated to find solely the license plate number. All character sequence groups are, instead, treated equally by the optical character recognition engine. Virtually each character sequence group in the image is treated as a possible license plate number. Identification incidence of license plate numbers is increased. The matched license plate numbers are readily verified by a system operator. Complexities inherent to previous vehicle identification systems are eliminated. The vehicle identification system remains operable whether the surveillance vehicle, the target vehicle, or both are stationary or moving.

BRIEF DESCRIPTION OF DRAWINGS

The invention will be more fully understood and further advantages will become apparent when reference is had to the following detailed description and the accompanying drawings, in which.

DESCRIPTION OF THE PREFERRED EMBODIMENTS

Figure 1:
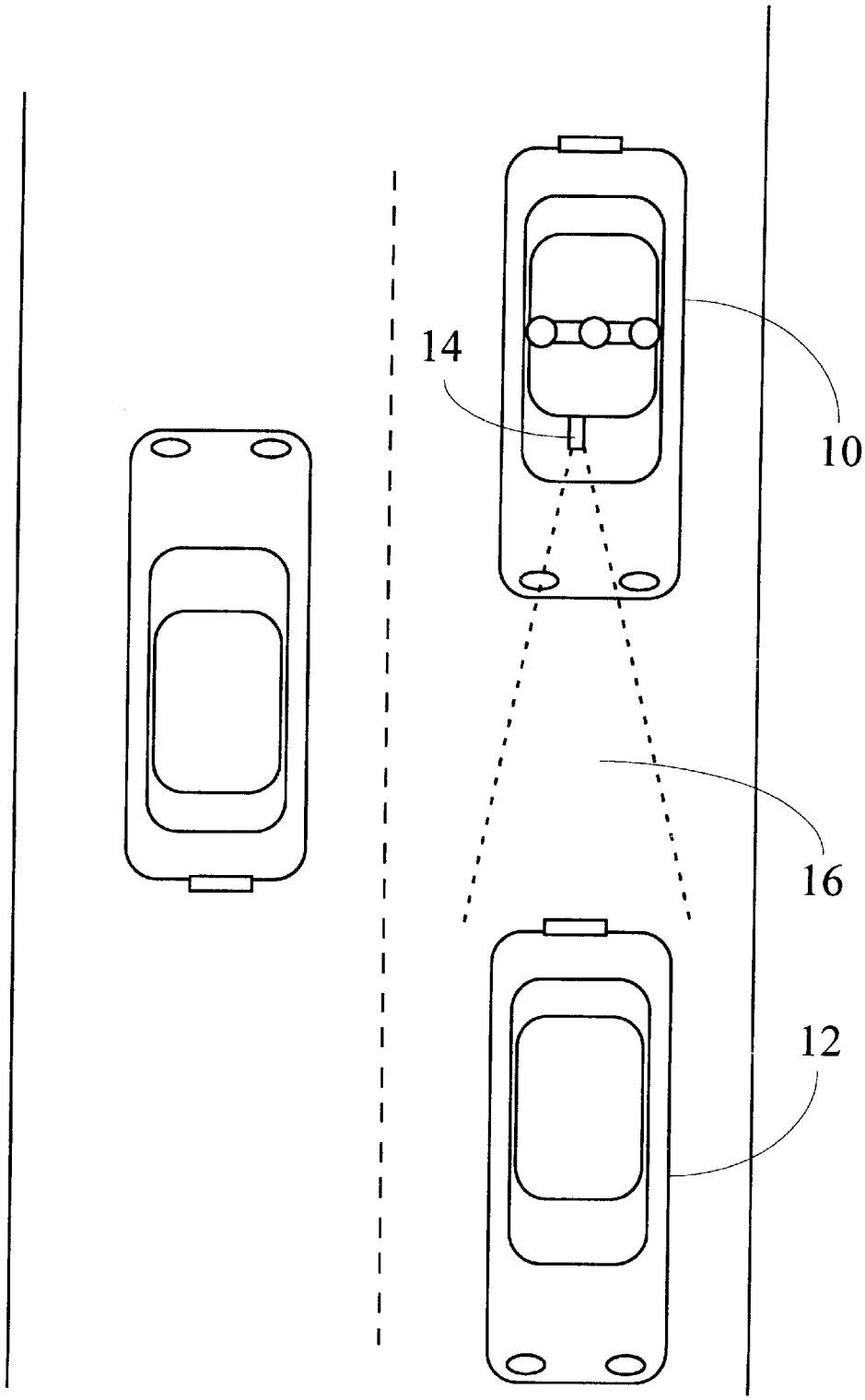
FIG. 1 is a plan view depicting a camera on a surveillance vehicle, a target vehicle, and the field of view of the camera.
Figure 2:
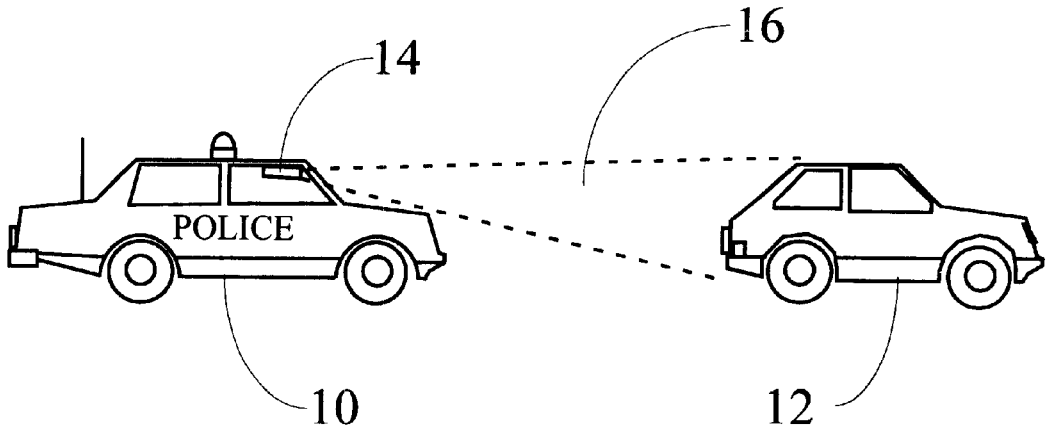
FIG. 2 is a side view of a surveillance vehicle, a target vehicle, and the field of view of the camera.

Referring to FIGS. 1 and 2 of the drawings, there is shown a license plate surveillance system for identifying license plate numbers on a license plate 11 (shown in FIG. 4) carried by a target vehicle 12. Generally stated, the system has an electronic camera 14 mounted on a surveillance vehicle 10. The electronic camera 14 captures an image of the license plate 11 of a vehicle 12 that enters within the field of view 16 of electronic camera 14. The field of view 16 is indicated by the dashed lines in each of FIGS. 1 and 2. Preferably, camera 14 is mounted inside surveillance vehicle 10 to protect it from dirt and water, and with its field of view 16 extending in a forward direction. Many police vehicles are equipped with cameras and video recorders. In this case, the output of camera 14 may be split into two signals: one signal for the system of the present invention; and the other signal for the video recorder. Preferably, the camera 14 is a color camera. Color increases the visibility of any text characters viewed by the camera. The resolution of the electronic camera 14 is preferably at least 192 by 165 pixels. More preferably, the resolution is at least 640 by 480 pixels. While not critical, the field of view 16 is preferably set such that the width of a typical automobile 12 located approximately 5 meters from the surveillance vehicle will fill the horizontal view of camera 14.

Figure 3:
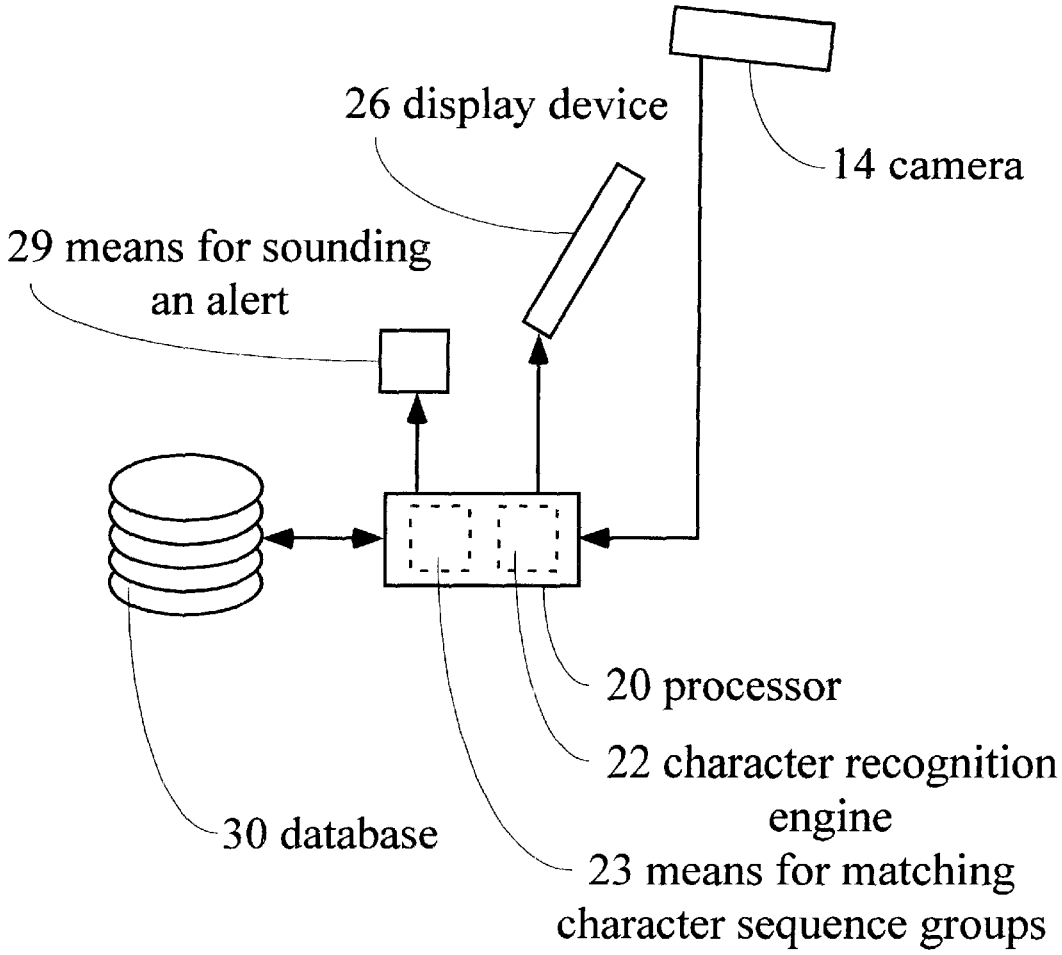
FIG. 3 is a block diagram depicting the components of a first embodiment of the invention.

FIG. 3 shows a block diagram of the various components of the system. Electronic camera 14 is connected to processor 20. The type of connection between camera 14 and processor 20 is not critical and may be of various types including video, RF, USB (universal serial bus), and IEEE 1394 (FireWire™) standards. An example of such a camera and processor is the COMPRO™ digital color camera with USB interface available from Jameco (part number 17152), and a PC or Macintosh laptop computer with USB interface.

A database 30 contains a list of license plate numbers and is connected to the processor 20. The license plate numbers listed in database 30 may be of a single State, such as NJ, NY, etc.; the entire nation; or a select list such as stolen or missing vehicles, or owners with outstanding warrants or parking tickets. Each license plate number in the database 30 has an associated record that contains other information about the vehicle and its owner. While the choice of memory device is not critical, preferably the database 30 is stored on a hard disk associated with the processor 20. Alternatively, the database 30 is stored on a CD associated with the processor 20.

Processor 20 has an optical character recognition engine 22 for converting any groups of text characters, herein referred to as character sequence groups, within the image captured by the electronic camera 14 to machine readable format, such as ASCII. The optical character recognition engine is preferably dedicated software or firmware associated with processor 20.

Figure 4:
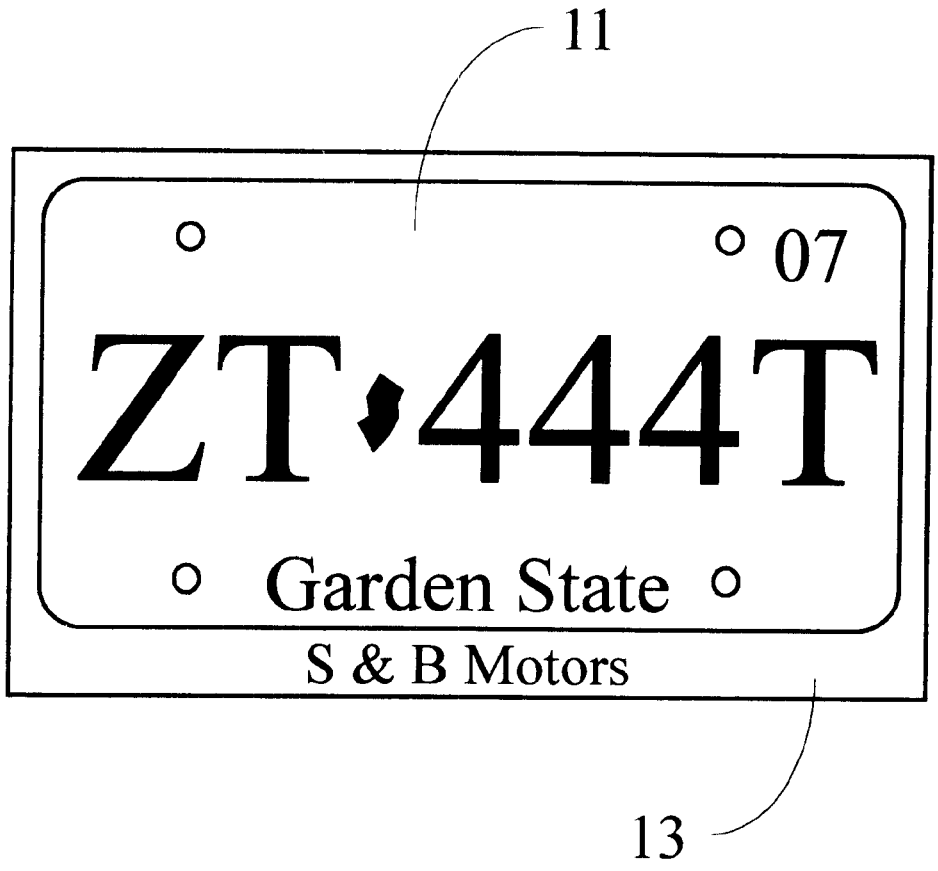
FIG. 4 is a side view depicting a typical license plate, a holder, and associated character sequence groups.

A typical license plate and holder are shown in FIG. 4. The optical character recognition engine searches an image, captured by camera 14, for character sequence groups. In the image might be the plate 11 as shown in FIG. 4, and possibly other text such as bumper stickers, and the like. Character sequence groups in this scenario are "07", "ZT*444T", "Garden", "State", and "S&B", and "Motors" on license plate holder 13. In addition, a bumper sticker might contribute the character sequence group "LEHIGH'. The * in the"ZT*444T" might result from the optical character recognition engine falsely interpreting the New Jersey symbol (between T and 4 in FIG. 4) as an asterisk. Preferably, the optical character recognition engine 22 eliminates special characters by referring to a predefined list of characters, such as *, ?I /, &, #, etc., stored in the processor 20 and deleting such characters. In this manner, the license plate number in FIG. 4 is interpreted correctly as ZT444T. As a further preference, character sequence groups of three or less characters are ignored. Optical character recognition is well known in the art and numerous software packages are available. In yet another preference, the optical character recognition engine 22 eliminates special character sequence groups that are members of a predefined list. Using the license plate of FIG. 4 as an example, special character sequence groups that could be included in the predefined list are "Jersey", "Garden", and "State". In this manner commonly anticipated character sequence groups that are not part of the license plate number are ignored by the system.

In tests, a camera connected to a Macintosh PowerBook laptop used OmmniPagePro™, by Caere Corporation, as the optical character recognition engine to successfully read license plate numbers. This system differs from previous vehicle identification systems in that there is no component designated to find the license plate number solely. With this system, all character sequence groups are treated equally by the optical character recognition engine.

Also associated with processor 20 is a means 23 for matching the character sequence groups with the license plate numbers in the database 30 in order to identify a matching license plate number. The means 23 for matching character sequence groups is well known in the art and is easily implemented with software or firmware. Each character sequence group is compared character for character with the license plate numbers in database 30. A matched number along with its associated record is displayed on the display device 26. Display device 26 is comprised of a LCD, CRT monitor, or the like, and it is connected to the processor 20 for displaying the matched license plate number and its associated record. Preferably, the processor 20 has means 29, such as a piezo buzzer or the like, for sounding an alert when a new record is displayed. Records indicating that the vehicle is stolen or that the owner is wanted by police cause the processor to sound an audible signal to the operator. The operator of the system, such as a police officer, verifies visually whether the displayed license plate number is the license plate number of the vehicle within the field of view of the camera.

Figure 5:
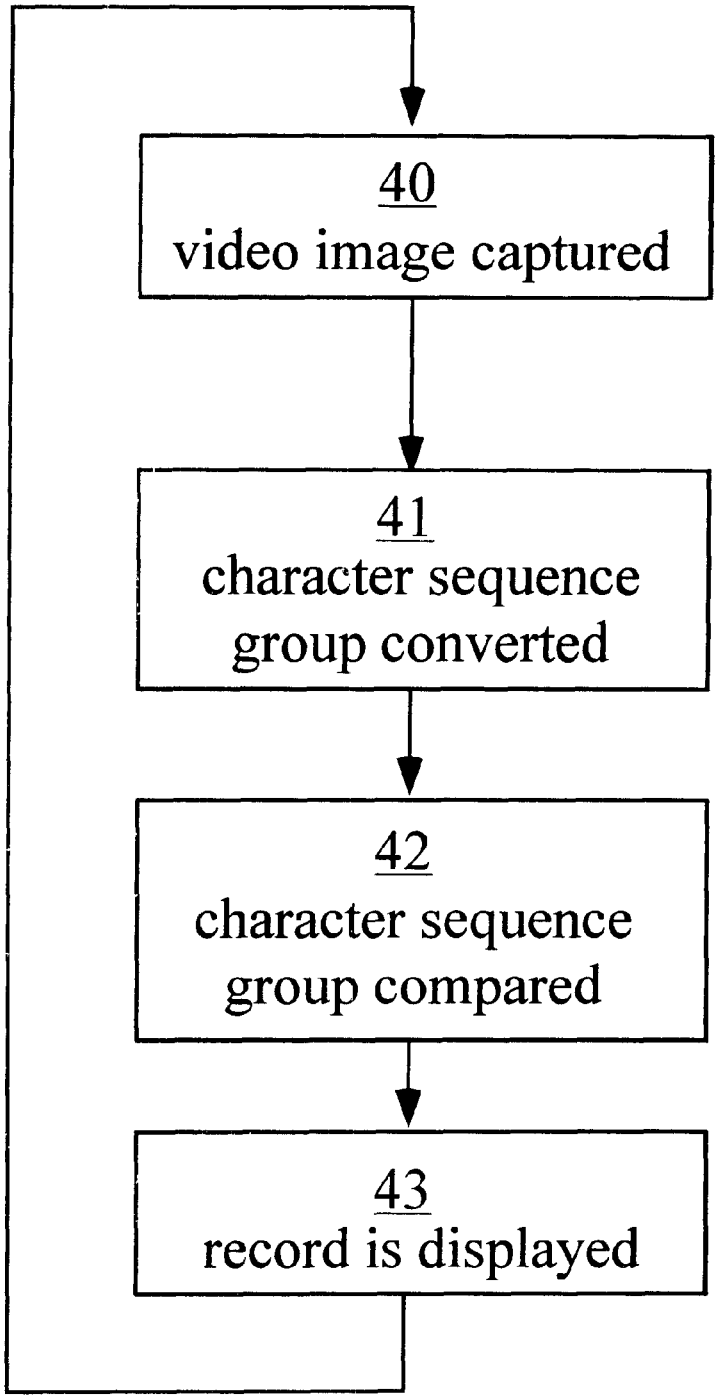
FIG. 5 is a block diagram illustrating a preferred method for practicing the invention.

Referring to FIG. 5 of the drawings, there is shown a method for identifying license plate numbers using an electronic camera mounted on a surveillance vehicle. First, a video image is captured 40 with an electronic camera. The image may or may not contain license plate. Any character sequence groups within the image are converted 41 to machine readable format using a processor having an optical character recognition engine as described above. The character sequence groups are compared 42 with license plate numbers in a database of license plate numbers in order to find a matching license plate number. Each license plate number in the database 30 has an associated record that contains other information about the vehicle and vehicle owner. The license plate numbers listed in the database maybe from: a single State, such as NJ, NY, etc.; the entire nation; or a select list such as stolen or missing vehicles, or owners with outstanding warrants or parking tickets. Finally, a matching license plate number and its associated record are displayed 43 on a display device in the surveillance vehicle. Preferably, this last step includes sounding an alert when a new record is displayed.

In this manner, a license plate number of any vehicle that happens to be in a field of view of the electronic camera is interpreted as a character sequence group, the character sequence groups found in the image are converted to machine readable format by the optical character recognition engine and are compared with the database, and any matching license plate number and its associated record is displayed within the surveillance vehicle.

Alternatively, the database for the above-described system is disposed in a location remote from the surveillance vehicle. In this alternative arrangement, the system further comprises a server associated with the database. Communication between the surveillance vehicle and the database is accomplished using a wireless transceiver within the surveillance vehicle for transmitting the character sequence groups to the server and receiving the associated records of matched license plate numbers, and a wireless transceiver associated with the server for receiving the character sequence groups and sending the records of matched license plate numbers to the surveillance vehicle. When the database is in a remote location, the system for identifying license plate umbers uses an electronic camera 54, shown in FIG. 6. The electronic camera 54 is mounted on surveillance vehicle 50 for capturing an image within the field of view 56 hereof. In the image may be a license plate 11 (shown in FIG. 4) or other text, such as bumper stickers, advertisements, etc. Each set of text characters make up a character sequence group.

As explained above, the image might contain the license plate 11 as shown in FIG. 4, and possibly other text such as bumper stickers, and the like. Character sequence groups in this scenario are "07", "ZT*444T", "Garden", "State", "S&B", and "Motors". In addition, a bumper sticker might contribute "LEHIGH", which might also be interpreted as a character sequence group. The * in the "ZT*444T" might result from the optical character recognition engine falsely interpreting the New Jersey symbol (between T and 4 in FIG. 4) as an asterisk. Preferably, the optical character recognition engine 62 eliminates special characters by referring to a predefined list of characters, such as *, 9,/, &,#, etc., stored in the processor 60 and deleting such characters. In this manner, the license plate number in FIG. 4 is interpreted correctly as ZT444T. It is also preferred that character sequence groups of three or less characters be ignored. Optical character recognition is well known in the art and numerous software packages are available. Further it is preferred that the optical character recognition engine 62 eliminate special character sequence groups that are members of a predefined list. Using the license plate of FIG. 4 as an example, special character sequence groups that could be included are "Jersey", "Garden", and "State".

Figure 6:
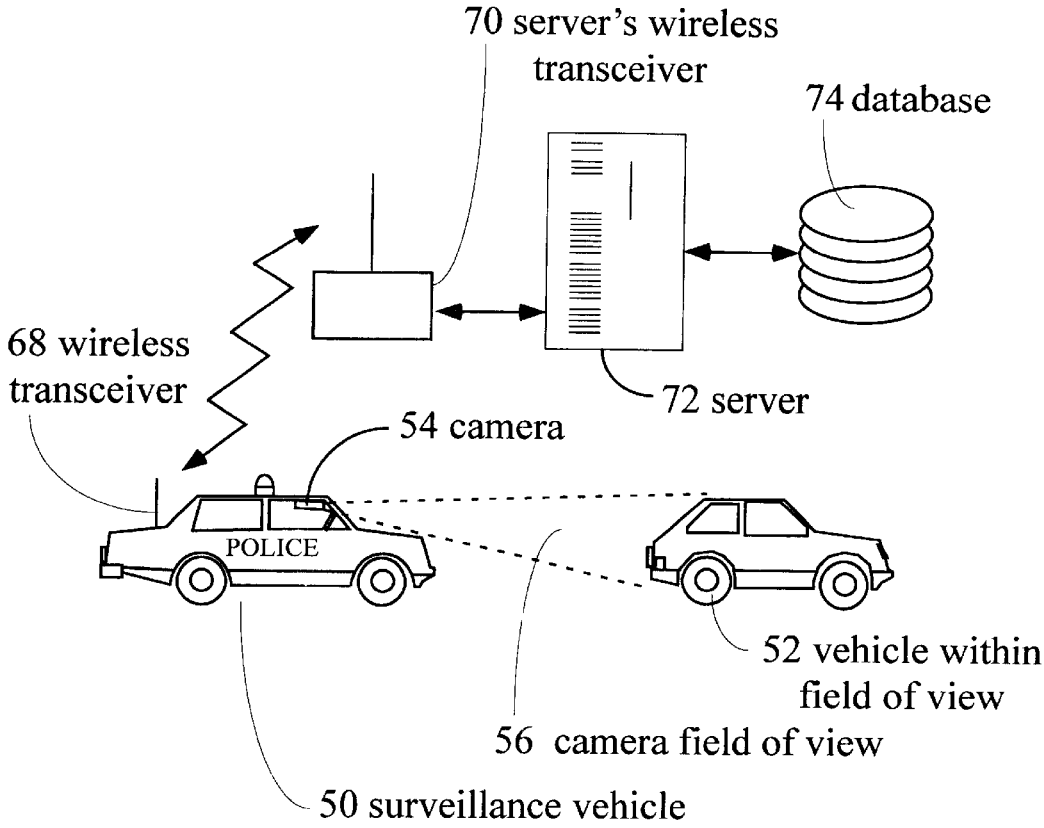
FIG. 6 is a block diagram depicting an alternate embodiment of the system having a remote database.
Figure 7:
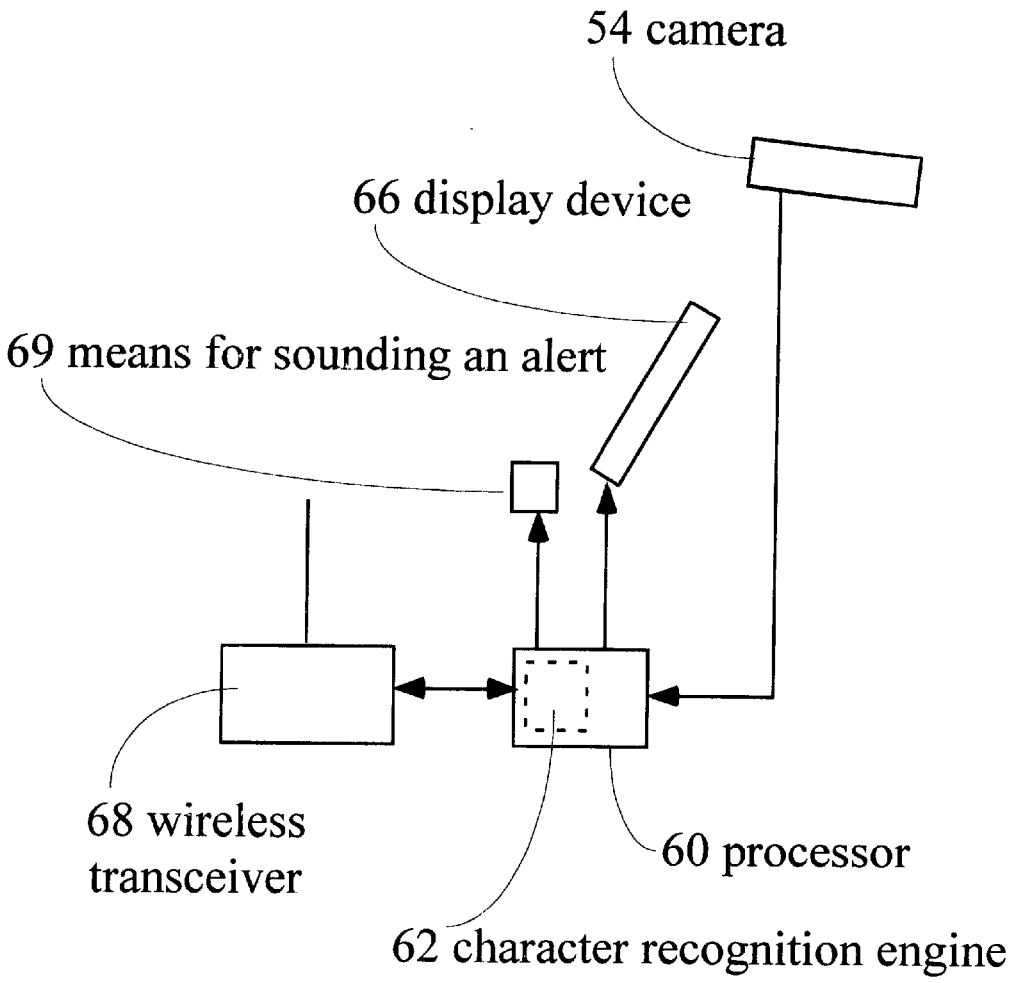
FIG. 7 is a block diagram of the components in a surveillance vehicle equipped with the system of FIG. 6.

The part of the system that is in the police vehicle is shown in FIG. 7. Processor 60 has an optical character recognition engine 62 for converting character sequence groups within the image to machine readable format. Processor 60 is disposed within surveillance vehicle 50. With further reference to FIG. 6, database 74, server 72, and server wireless transceiver 70 are located in a police station, data center, or other remote location. Database 74 contains license plate numbers and is located away from the surveillance vehicle. Each of the license plate numbers has an associated record as described above. A server 72 is connected to the database 74. The server 72 compares character sequence groups with the license plate numbers in the database 74 to find a matching license plate number. A vehicle wireless transceiver 68 is located at the surveillance vehicle 50 for transmitting to the server 72 character sequence groups that are interpreted by the optical character recognition engine 62 to be in the image. The vehicle wireless transceiver 68 is also used to receive any matched license plate number and associated record from the server 72. A server wireless transceiver 70 is connected to the server 72 for receiving the character sequence groups and sending the matching license plate number and associated record to the surveillance vehicle. Preferably, the wireless transceivers are wireless modems connected to the Internet. Alternatively, the wireless transceivers are wireless telephone connections between the server 72 and the processor 60. A display device 66 is located at the surveillance vehicle 50 for displaying the matching license plate number and its associated record. Preferably, the processor 60 has means 69, such as a piezo buzzer or the like, for sounding an alert when a new record is displayed.

Figure 8:
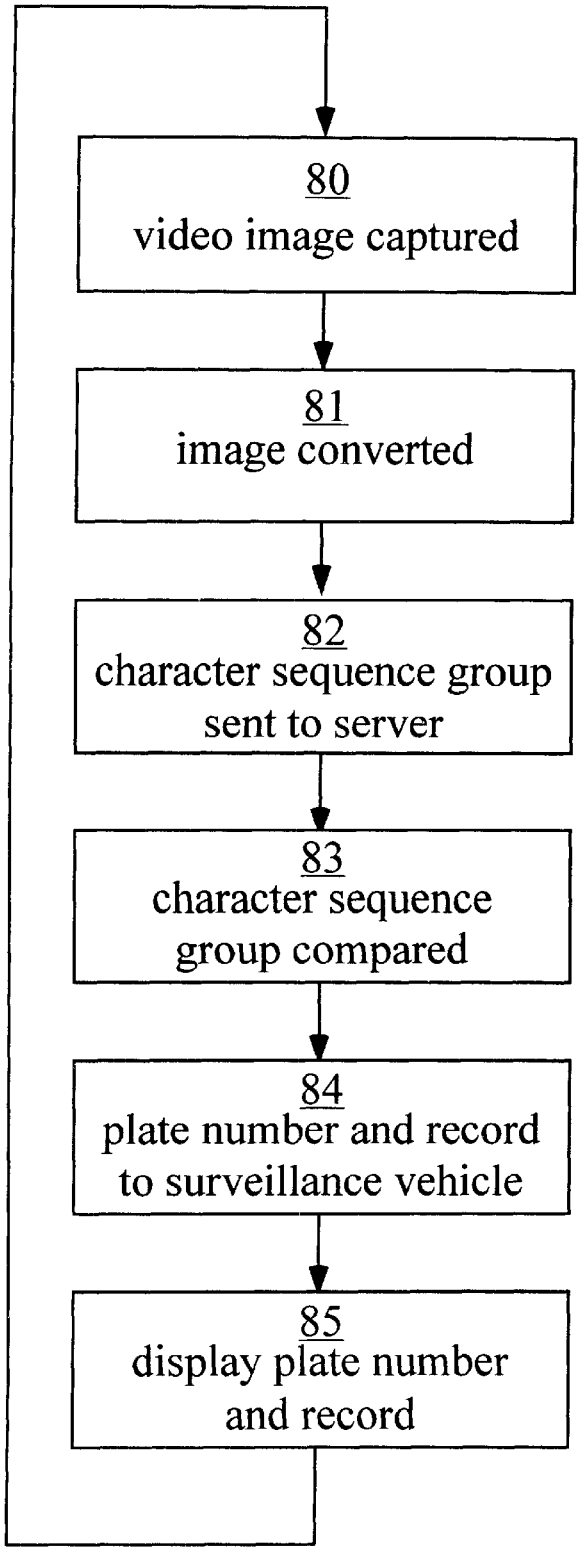
FIG. 8 is a block diagram illustrating method steps for practicing an alternative embodiment of the invention.

Referring to FIG. 8 there is shown a method for identifying license plate numbers when the database containing license plate number is remote from the surveillance vehicle. A video image is captured 80 with an electronic camera mounted on a surveillance vehicle. Character sequence groups within the image are converted 81 to machine readable format using a processor having an optical character recognition engine. The character sequence groups are sent 82 via wireless connection to a server having a database of license plate numbers. Each of the license plate numbers in the database has an associated record containing information about the vehicle and vehicle owner. The character sequence groups are compared 83 with license plate numbers in the database in order to find a matching license plate number. The matching license plate number and associated record are sent 84 via wireless connection to the surveillance vehicle. Each of the matching license plate number and associated record is displayed 85 on a display device in the surveillance vehicle. Preferably, the preceding step includes the step of sounding an alert when a new record is displayed. Preferably also, the method is repeated continuously. Each of the matched license plate number and associated record is is played on the display device, forming a list. Duplicate matched license plate numbers are ignored when matched within a predetermined time period, which ranges from about 15 to 60 minutes, and is preferably about 30 minutes.

In this manner the license plate number of any vehicle extant within a field of view of the electronic camera is interpreted as a character sequence group. The character sequence groups found in the image are converted to machine readable format by the optical character recognition engine and compared with the database. Each matching license plate number and associated record is displayed within the surveillance vehicle. Preferably those character sequence groups that are members of a predetermined list will not be compared, sent, or displayed. Characters within the character sequence group, that are members of a predetermined list will not be included as part of the character sequence group.

Having thus described the invention in rather full detail, it will be understood that such detail need not be strictly adhered to, but that additional changes and modifications may suggest themselves to one skilled in the art, all falling within the scope of the invention as defined by the subjoined claims.

We claim:

1. A method of identifying licence plate numbers, using an electronic camera mounted on a surveillance vehicle, comprising the steps of (a) capturing a video image with said electronic camera;

(b) converting any character sequence groups within said image to machine readable format using a processor having an optical character recognition engine;

(c) comparing said character sequence groups with license plate numbers in a database in order to find a matching license plate number, said license plate numbers in said database each having an associated record; and (d) displaying said matching license plate number and associated record on a display device in said surveillance vehicle, whereby a license plate number of any vehicle extant within a field of view of said electronic camera is interpreted as a character sequence group, the character sequence group found in the image is converted to machine readable format by said optical character recognition engine and compared with said database, and any matching license plate number and associated record is displayed within said surveillance vehicle.

2. A method as recited by claim 1, wherein steps "a" through "d" are continuously repeated and each unique record is displayed on said display device forming a list.

3. A method as recited by claim 1, wherein a duplicate of said license plate number and its associated record will not be displayed on said display means within a redetermined time period.

4. A method as recited by claim 1, wherein a character sequence group that is a member of a predetermined list will not be compared, sent, or displayed.

5. A method as recited by claim 1, wherein a character that is within any said character sequence group and is a member of a predetermined list will not be included as part of said character sequence group.

6. A system for identifying license plate numbers, using an electronic camera mounted on a surveillance vehicle, comprising:

(a) an electronic camera mounted on a surveillance vehicle for capturing an image within the field of view of said camera;

(b) a database containing a plurality of license plate numbers, each of said license plate numbers having an associated record;

(c) a processor having an optical character recognition engine for converting any character sequence groups within said image to machine readable format, and means for matching said character sequence groups with said license plate numbers in said database in order to identify a matching license plate number;

(d) a display means within said surveillance vehicle for displaying said matching a matched license plate number and its associated record, whereby a license plate number for a vehicle extant within a field of view of said electronic camera is interpreted as a character sequence group, every character sequence group found in said image is converted to machine readable format by said optical character recognition engine and is compared with said database, and each matched license plate number and associated record is displayed within said surveillance vehicle.

7. A system as recited by claim 6, further comprising means for sounding an alert when said matching license plate number is displayed.

8. A method for identifying license plate numbers using an electronic camera mounted on a surveillance vehicle, comprising the steps of:

(a) capturing a video image with said electronic camera;

(b) converting any character sequence groups within said image to machine-readable format using a processor having an optical character recognition engine;

(c) sending said character sequence groups via wireless connection to a server having a database of license plate numbers, said license plate numbers in said database each having an associated record;

(d) comparing said character sequence groups with license plate numbers in said database in order to find a matching license plate number;

(e) sending said matching license plate number and associated record via wireless connection to said surveillance vehicle; and (f) displaying said matching license plate number and associated record on a display device in said surveillance vehicle, whereby a license plate number for each vehicle extant within a field of view of said electronic camera is interpreted as a character sequence group, each character sequence group found in said image is converted to machine readable format by said optical character recognition engine and is compared with said database, and each of said matching license plate numbers and associated record is displayed within said surveillance vehicle.

9. A method as recited by claim 8, wherein each of steps a through d is continuously repeated and each unique record is displayed on said display device, forming a list.

10. A method as recited by claim 8, wherein no duplicate of said license plate number and associated record is displayed on said display means during a predetermined time period.

11. A method as recited by claim 8, wherein no character sequence groups that are members of a predetermined list are compared, sent, or displayed.

12. A method as recited by claim 8, wherein no characters within said character sequence groups that are members of a predetermined list are included as part of said character sequence groups.

13. A system for identifying license plate numbers, using an electronic camera mounted on a surveillance vehicle, comprising:

(a) an electronic camera mounted on a surveillance vehicle for capturing an image within the field of view of said camera;

(b) a processor having an optical character recognition engine for converting any character sequence groups within said image to machine readable format;

(c) a database of license plate numbers, said license plate numbers each having an associated record;

(d) a server associated with said database for comparing said character sequence groups with said license plate numbers in said database to find a matching license plate number;

(e) a vehicle wireless transceiver within said surveillance vehicle for transmitting said character sequence groups to said server and receiving said matched license plate number and associated record;

(f) a server wireless transceiver associated with said server for receiving said character sequence groups and sending said matching license plate number and associated record to said surveillance vehicle;

(g) a display device within said surveillance vehicle for displaying said matching license plate number and its associated record, whereby a license plate number for any vehicle extant within a field of view of said electronic camera is interpreted as a character sequence group, each character sequence group found in said image is converted to machine readable format by said optical character recognition engine and is compared with said database, and each matching license plate number and associated record is displayed within said surveillance vehicle.

14. A system as recited by claim 13, further comprising means for sounding an alert when said matching license plate number is displayed.

* * * * *